US007883116B2

(12) United States Patent
Canale

(10) Patent No.: US 7,883,116 B2
(45) Date of Patent: Feb. 8, 2011

(54) TELESCOPIC TUBE FOR ELECTRIC HOUSEHOLD APPLIANCES EQUIPPED WITH ELECTRICITY CONDUCTION MEANS

(75) Inventor: Giuseppe Canale, Gorla Minore (IT)

(73) Assignee: OMEC S.p.A., Gorla Minore (IT)

( * ) Notice: Subject to any disclaimer, the term of this patent is extended or adjusted under 35 U.S.C. 154(b) by 694 days.

(21) Appl. No.: 11/632,642

(22) PCT Filed: Jun. 27, 2005

(86) PCT No.: PCT/EP2005/006909

§ 371 (c)(1),
(2), (4) Date: Nov. 13, 2007

(87) PCT Pub. No.: WO2006/007939

PCT Pub. Date: Jan. 26, 2006

(65) Prior Publication Data

US 2008/0143097 A1 Jun. 19, 2008

(30) Foreign Application Priority Data

Jul. 16, 2004 (IT) ..... MI2004A1429

(51) Int. Cl.
*A47L 9/24* (2006.01)

(52) U.S. Cl. ..... 285/7; 285/301; 285/303; 285/907

(58) Field of Classification Search ..... 285/7, 285/301, 303, 907; 174/47; 439/191–194; 15/300, 311, 314, 315, 377, 410, 414; 403/109.1–109.8
See application file for complete search history.

(56) References Cited

U.S. PATENT DOCUMENTS 3,534,317 A 10/1970 Descarries et al.
3,614,705 A * 10/1971 Descarries et al. ..... 439/23
5,180,316 A * 1/1993 Miller et al. ..... 439/607.5
5,289,605 A * 3/1994 Armbruster ..... 15/97.1

(Continued)

FOREIGN PATENT DOCUMENTS

DE 44 04 394 8/1995

(Continued)

OTHER PUBLICATIONS

International Search Report for PCT/EP2005/006909 mailed Nov. 16, 2005.

*Primary Examiner*—James M Hewitt
*Assistant Examiner*—Jay R Ripley
(74) *Attorney, Agent, or Firm*—Nixon & Vanderhye, P.C.

(57) ABSTRACT

A telescopic tube for an electric household appliance comprises a first outer tube and a second inner tube slidable inside the first outer tube. An eletricity conduction system comprises: a) an elongate guide body comprising non electrically conductive material; b) a locking member for connecting the first end of the elongated guide body to the second inner tube; c) an outer channel connected to an outer surface of the first outer tube, the outer channel being provided for slidingly receiving the elongated guide body; d) a pair of tubular-shaped electric conductors contained in the elongated guide body; and e) a corresponding pair of substantially rigid rod-shaped electric conductors which are able to slide, at least partially, within the tubular-shaped electric conductors so that each rod-shaped electric conductor is in contact with an inner surface of a corresponding tubular-shaped electric conductor.

12 Claims, 13 Drawing Sheets

U.S. PATENT DOCUMENTS

| | | | | | |
|---|---|---|---|---|---|
| 5,332,266 | A | | 7/1994 | Canale | 285/7 |
| 5,740,583 | A | * | 4/1998 | Shimada et al. | 15/377 |
| 5,768,745 | A | * | 6/1998 | Lee | 15/373 |
| 6,148,474 | A | * | 11/2000 | Ohara et al. | 15/377 |
| D453,866 | S | * | 2/2002 | Nighy et al. | D32/31 |
| 6,435,754 | B1 | | 8/2002 | Canale | 403/109.2 |
| 6,474,696 | B1 | | 11/2002 | Canale | 285/7 |
| 6,486,396 | B2 | * | 11/2002 | Stein | 174/47 |
| 7,025,383 | B2 | | 4/2006 | Canale | 285/7 |
| 7,552,806 | B2 | * | 6/2009 | Tong | 191/12 R |
| 2004/0051302 | A1 | | 3/2004 | Canale | 285/7 |

FOREIGN PATENT DOCUMENTS

| | | | | | |
|---|---|---|---|---|---|
| DE | 195 35 493 | | | 3/1997 | |
| DE | 197 31 559 | | | 1/1998 | |
| DE | 101 50 462 | | | 5/2003 | |
| EP | 0 520 534 | | | 5/1994 | |
| EP | 0 738 492 | | | 10/1996 | |
| EP | 0 601 620 | | | 9/1997 | |
| EP | 0 835 632 | | | 4/1998 | |
| EP | 0 848 926 | | | 4/2001 | |
| EP | 1 092 383 | | | 4/2001 | |
| EP | 0 987 976 | | | 3/2002 | |
| JP | 04189337 | A | * | 7/1992 | 15/414 |

* cited by examiner

TELESCOPIC TUBE FOR ELECTRIC HOUSEHOLD APPLIANCES EQUIPPED WITH ELECTRICITY CONDUCTION MEANS

This application is the US national phase of international application PCT/EP2005/006909 filed 27 Jun. 2005, which designated the U.S. and claims priority to IT MI2004A001429 filed 16 Jul. 2004, the entire content of each of which is hereby incorporated by reference.

BACKGROUND

I. Field of the Invention

The present invention relates to a telescopic tube for electric household appliances. In particular, the present invention concerns a telescopic tube for electric household appliances equipped with means for conducting electricity along the said tube.

II. Related Art and Other Considerations

In the sector of electric household appliances such as vacuum cleaners, carpet beaters or the like it is advantageous to use telescopic tubes which increase the versatility thereof. Particularly advantageous are so-called "electrified telescopic tubes", namely tubes comprising means for conducting electricity along the said tube. These may be used, for example, in a vacuum cleaner where it is required to position the ON/OFF button on the handle of the appliance or in order to prevent the electric power supply cable from interfering with the suction nozzle (also called "brush").

In the description below, "closed configuration" will be understood as meaning the configuration where the telescopic tube assumes a minimum length, while "extended configuration" is understood as meaning the configuration where the telescopic tube is at least partially extended telescopically. In particular, in the "completely extended configuration" the tube assumes its maximum length.

Electrified telescopic tubes are already known in the art. DE 195 35 493 describes an electrified telescopic tube for a vacuum cleaner, comprising an extendable suction duct to which a cabling duct housing an electric cable is connected by means of suitable fixing rings. Inside the cabling duct there is a movable pulley system with springs; the pulley may perform axial translatory movements inside the cabling duct. The cable is wound around the pulley and forms an extra bend inside the cabling duct. In this way, when the vacuum cleaner tube is extended, the electric cable inside the cabling duct is unwound at least partially. The cable is kept tensioned by the recall force of the springs. When the tube is again brought into the closed configuration, the action of the recall force of the springs allows the original configuration of the cable and the pulley to be restored and at the same time the cable to be kept tensioned.

The solution of DE 195 35 493 involves certain disadvantages: the presence of the pulley system inside the cabling duct results in excessively large dimensions of the said duct and consequently the electrified telescopic tube. For this reason, this type of tube is not very easy to handle and therefore unsuitable for use in electric household appliances. Moreover, so that the cable may be housed inside the cabling duct and wound around the pulley, it must be bent inside the cabling duct; these bent sections result in wear of the cable—in particular its insulating coating—and therefore with time may give rise to dangerous short-circuits.

Moreover this known electrified tube has a complicated structure and requires assembly which is long and costly.

EP 0,848,926 B1 discloses a second type of electrified telescopic tube for a vacuum cleaner. This tube is formed by an outer suction tube, an inner suction tube which is partially slidable inside the outer suction tube, an outer cabling duct and an inner cabling duct which is partially slidable inside the outer cabling duct. The cabling ducts, which are partially inserted one inside the other, contain an electric cable; moreover they are arranged outside the inner suction tube and inside the outer suction tube. The electric cable has a linear length greater than the length of the tube in the extended configuration and, so as to be able to assist the telescopic extension thereof, is wound helically inside the cabling ducts.

The solution of EP 0.848,926 B1 is also disadvantageous in terms of overall dimensions of the tube: helical winding of the electric cable in fact requires the cabling duct having dimensions such as to prevent excessive bending of the cable, in order to prevent problems of wear thereof which may result in dangerous short-circuits. Moreover, in this type of electrified telescopic tube, the outer suction tube surrounds both the inner suction tube and both the cabling ducts. In order to reduce the cross-sectional dimension of the outer suction tube, ducts and tubes with an irregularly shaped cross-section are used, these being difficult and costly to produce.

EP 0 835 632 A discloses an adjustable electrical connection device for telescopic vacuum cleaner hose. The arrangement comprises at least two hollow tube parts which are inserted into each other and mechanically coupled to sections of the telescopic tube. The tube parts include electric connector devices at ends which oppose each other. The electric connectors are connected to each other over an electric conductor which is arranged in the interior of the tube parts. A section of the electric conductor in the interior of the tube part which is stationary with respect to the other tube part, is arranged as a coil. Elastic clamp parts are preferably formed in the tube part with the coiled conductor to prevent tensions on the conductor, whereby one clamp part is arranged at the end of the connector, and the other end is arranged at the end of the moving tube part, where the conductor is inserted.

The arrangement according to EP 0 835 632 is disadvantageous as it is not safe, it is rather complicated to be assembled and bulky.

EP 0 738 492 A describes several embodiments of extension pipes for electric vacuum cleaners. The extension pipes comprise a first and a second casings housing a flexible conductor connecting two terminals.

DE 197 31 559 A discloses a vacuum cleaner. The vacuum cleaner has in the suction nozzle a third wire and a rotating brush driven by a motor. The suction nozzle and a connecting piece of the handgrip are joined by an extension piece which is hollow, through which the dust-containing air flows and which is connected with one wire of the suction hose. The length of the extension piece can be altered in controlled fashion. The extension piece has a first bit with a first wire introduced first of all into the connecting piece of the handgrip and a second bit in which a third wire is introduced and which is designed so that its length can be altered with the first bit.

U.S. Pat. No. 3,534,317 discloses a system and apparatus for electrically connecting a vacuum cleaner and a remote motor driven brush tool.

DE 44 04 394 A discloses an adjustable electrical connection device for telescopic vacuum cleaner hose The arrangement comprises at least two hollow tube parts which are inserted into each other and mechanically coupled to sections of the telescopic tube. The tube parts include electric connector devices at ends which oppose each other. The electric connectors are connected to each other over an electric conductor which is arranged in the interior of the tube parts. A section of the electric conductor in the interior of the tube part which is stationary w.r.t. to the other tube part, is arranged as a coil. Elastic clamp parts are pref. formed in the tube part with the coiled conductor to prevent tensions on the conductor, whereby one clamp part is arranged at the end of the connector, and the other end is arranged at the end of the moving tube part, where the conductor is inserted.

SUMMARY

An object of the technology disclosed herein is to provide an improved telescopic tube for electric household appliances equipped with electricity conduction means.

In particular, a first object of the technology disclosed herein is to provide a telescopic tube of the abovementioned type which is light and manageable and therefore suitable for use in electric household appliances such as a vacuum cleaner or the like.

A further object of the technology disclosed herein is to provide a telescopic tube of the abovementioned type in which the electricity conduction means are more resistant to wear than those present in the known tubes and in which in general the risk of short-circuits and domestic accidents is reduced.

A further object of the technology disclosed herein is to provide a telescopic tube of the abovementioned type which is simpler and cheaper to produce than the known tubes.

According to an aspect of the technology disclosed herein, a telescopic tube comprising a first outer tube and a second inner tube slidable inside the first outer tube is provided. The telescopic tube further comprises and electricity conduction means for conducting electricity from the first tube to the second tube, wherein the electricity conduction means comprise:

a) an elongate guide body made of a non electrically conductive material having a first end and a second end;
b) a locking member for connecting the first end of the elongated guide body to the second inner tube so that the elongated guide body is connected to the second inner tube in a substantially cantilever manner;
c) an outer channel connected to an outer surface of the first outer tube, the outer channel being provided for slidingly receiving the elongated guide body;
d) a pair of tubular-shaped electric conductors contained in the elongated guide body; and
e) a corresponding pair of substantially rigid rod-shaped electric conductors which are able to slide, at least partially, within the tubular-shaped electric conductors so that each rod-shaped electric conductor is in contact with an inner surface of a corresponding tubular-shaped electric conductor.

When the tube is converted from the closed configuration into the extended configuration, the tubular conductors and the rod-shaped conductors slide with respect to each other and each integrally with the outer and inner tube respectively. The electrical contact between the two conductors is ensured, irrespective of their relative position, by the sliding contact.

The advantages of this type of tube compared to the known solutions are several. First of all, the electric contact is provided by means of conductors which are substantially linear and which, being arranged parallel to the axis of the tube, occupy a limited amount of space. The cross-sectional dimension of the telescopic tube according to the invention is in fact less than that of a telescopic tube equipped with a cabling duct of the known type. The telescopic tube according to the present invention is therefore very easy to handle.

Moreover, the use of substantially linear conductors for conducting electricity results in an improvement in terms of wear-resistance since the conductors and the associated insulating coatings are not subject to any mechanical tension due to bending. Therefore, the risks of wear of the insulating coatings and consequent short-circuits are limited compared to known solutions.

Finally, in a preferred embodiment, the rod-shaped conductors and the tubular conductors have a circular cross-section and are therefore easy and inexpensive to produce; the cross-sections of the guide body and the outer channel may also be chosen so as to be easy and inexpensive to produce. The same considerations apply to the cross-sectional form of the inner tube and outer tube.

Preferably, the rod-shaped electric conductors comprise contact members so that each rod-shaped electric conductor is in sliding electric contact with the inner surface of the corresponding tubular-shaped electric conductor.

Preferably, the contact members are terminal members which are at least partly elastic.

Advantageously, the rod-shaped electric conductors comprise an electric conductive core and an insulating coating.

Preferably, the tubular-shaped electric conductors are in the form of electrically conductive tubes embedded in the elongated guide body.

According to a preferred embodiment, the tubular-shaped electric conductors have a first length and the elongate guide body has a second length, the first length being lower than the second length.

The elongate guide body could be solid. Advantageously, the elongate guide body is made of a plastic material.

Profitably, the outer channel is at least partially connected to the outer surface of the first outer tube by an adhesive. Advantageously, it is at least partially connected to the first outer tube by a bi-adhesive tape.

Preferably, the shape of the cross-section of the elongate guide body substantially complements a shape of the internal cross-section of the outer channel.

Preferably, the locking member comprises terminals, the terminals being connected to wire ends of a cable and being inserted inside the tubular-shaped electric conductors.

Advantageously, the telescopic tube also comprises a further locking member, the further locking member housing a contact block for connecting an electric power supply cable with the rod-shaped electric conductors.

According to a second aspect, the technology disclosed herein provides an electric household appliance comprising a telescopic tube as set forth above.

BRIEF DESCRIPTION OF THE DRAWINGS

Further features and advantages of the technology disclosed herein will become clear from the following description, provided by way of a non-limiting example, to be read in conjunction with the accompanying figures in which.

Some of the figures are not shown to scale. The same reference numbers have been used in the various figures in order to indicate the same components or components which are functionally equivalent.

DETAILED DESCRIPTION

Figure 1:
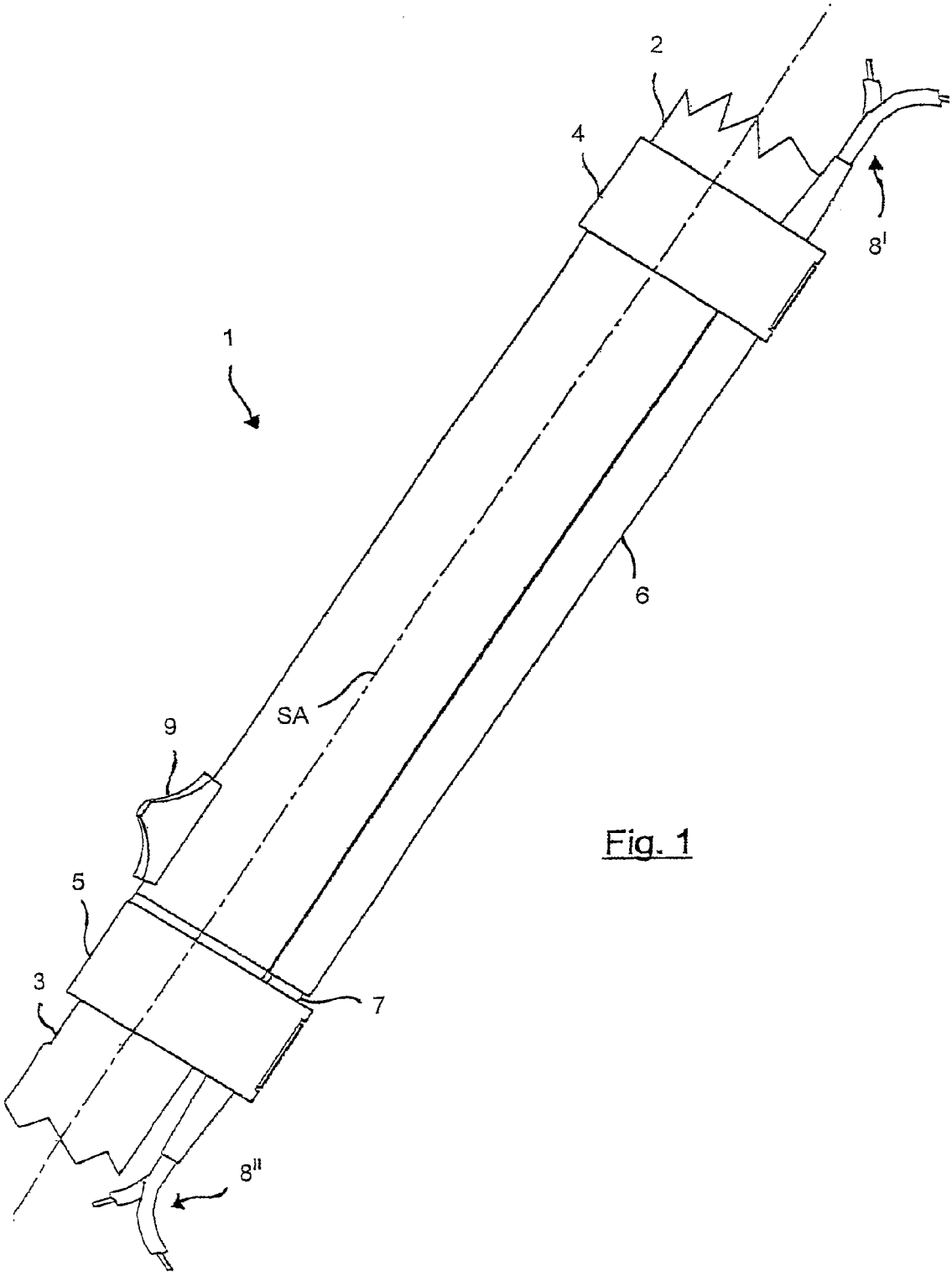
FIG. 1 is an axonometric view of a part of a telescopic tube according to the technology disclosed herein in its closed configuration.
Figure 2:
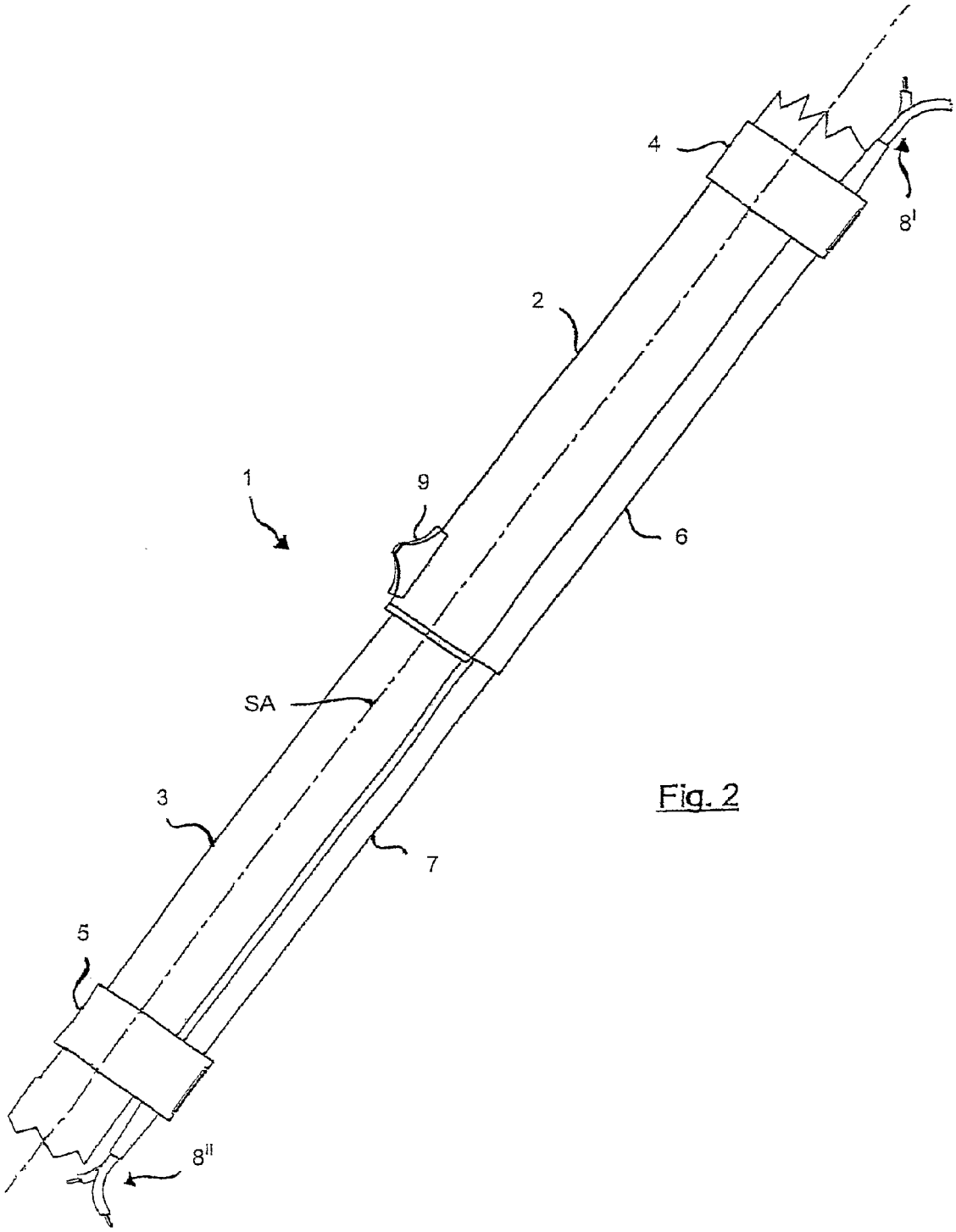
FIG. 2 is an axonometric view of a part of the telescopic tube according to the technology disclosed herein in its extended configuration.

FIG. 1 and FIG. 2 are axonometric views of the telescopic tube according to the technology disclosed herein, in its closed and extended configuration, respectively. The telescopic tube 1 comprises an outer tube 2, an inner tube 3 sliding inside the outer tube 2, an outer channel 6 fixed to the outer tube 2 and a guide body 7 fixed to the inner tube and sliding inside the outer channel 6. A pushbutton 9 for actuating the telescopic extension mechanism projects from the outer tube. The outer channel 6 and the guide body 7 comprise conductive means which allow electrical conduction along the telescopic tube 1, namely means which provide an electrical contact between two electric power cables 8' and 8" from the network and to the motor of an electric household appliance. The conductive means are not shown in FIGS. 1 and 2 but will be described further below with reference to the other figures. FIGS. 1 and 2, on the other hand, show locking collars 4 and 5 which will be described in detail below.

Figure 3:
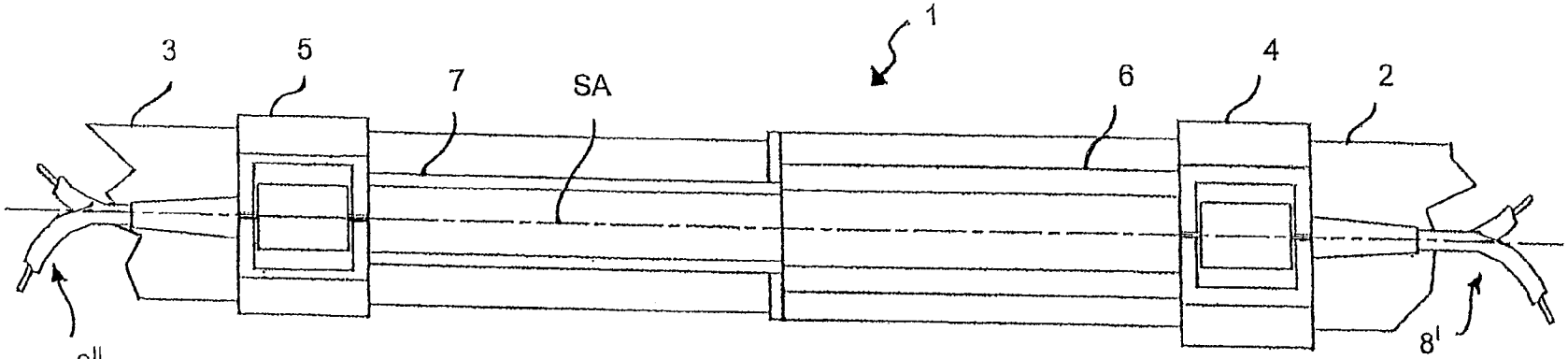
FIG. 3 is a plan view, from above, of a part of the telescopic tube according to the technology disclosed herein in an extended configuration.
Figure 4:
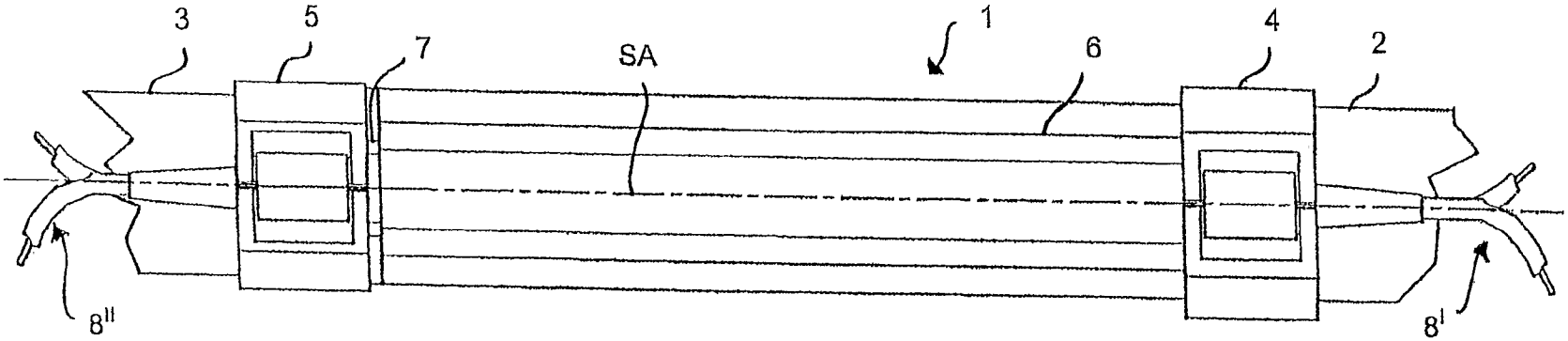
FIG. 4 is a plan view, from above, of a part of the telescopic tube according to the technology disclosed herein in its closed configuration.

FIGS. 3 and 4 show plan views, from above, of the telescopic tube according to the technology disclosed herein, in the closed and extended configuration, respectively.

It will be understood, by comparing FIGS. 1 and 3 (closed configuration) and 2 and 4 (extended configuration) that extension of the telescopic tube 1 is performed by means of sliding of the inner tube 3 inside the outer tube 2 and guide body 7 inside the outer channel 6.

Figure 5:
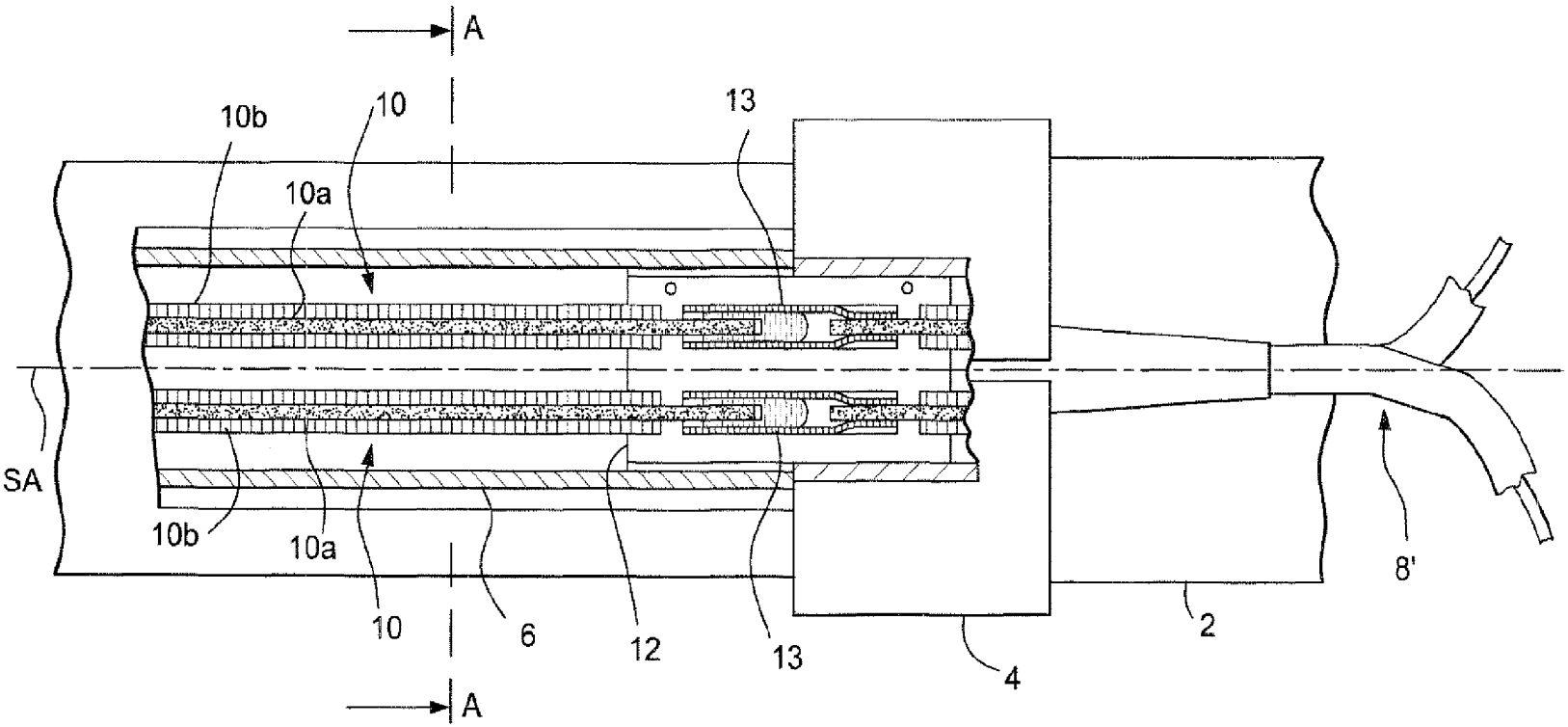
FIG. 5 is a view from above, partially longitudinally sectioned, of the right-hand end part in FIG. 3.
Figure 8:
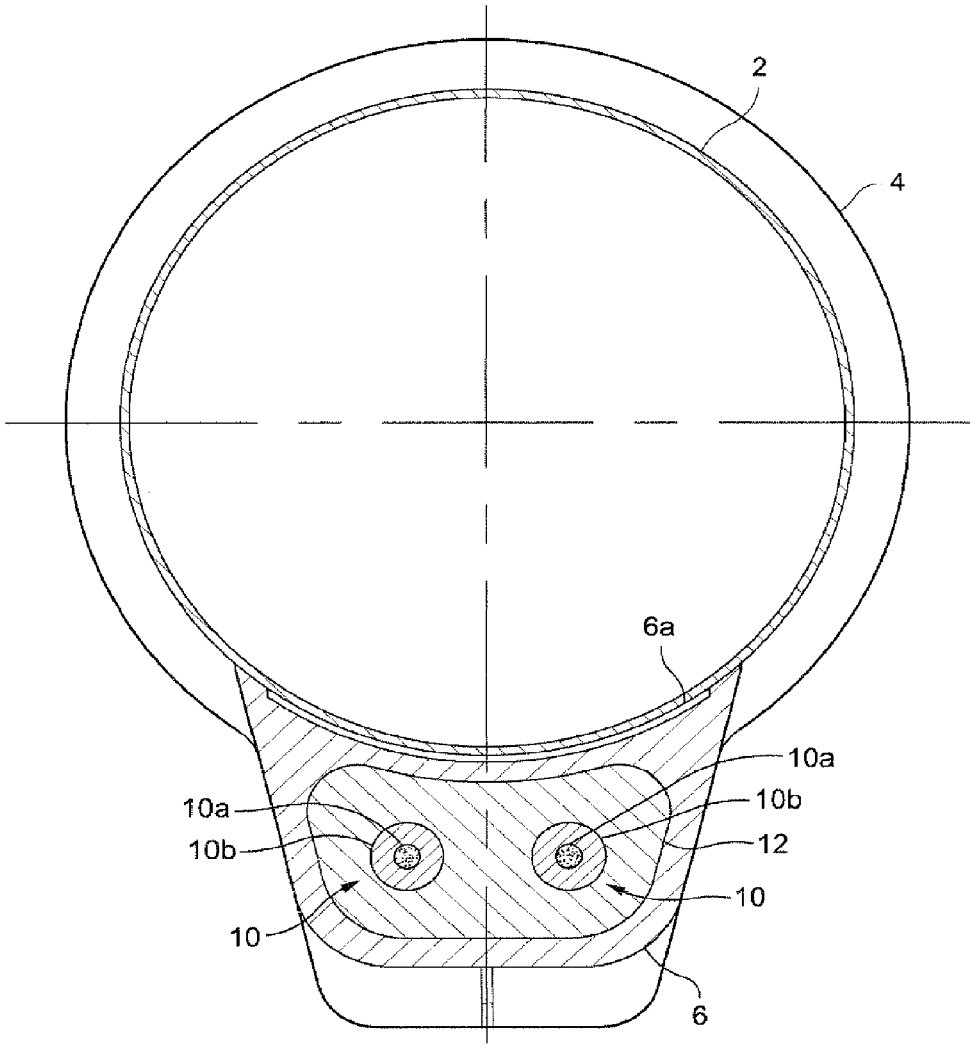
FIG. 8 is a cross-sectional view, along the line A-A of FIG. 5, of the telescopic tube according to the technology disclosed herein.

Specific reference should now be made to FIGS. 5 and 8. The outer tube 2 has a substantially circular cross-section with a longitudinal axis SA and is preferably made of metallic material.

The outer channel 6 has a substantially rectilinear axis and is fixed to the outer tube 2 parallel to its longitudinal axis SA. The outer channel 6 is made equally well of plastic material or metallic material by means of extrusion or moulding. According to an advantageous embodiment, the outer channel 6 is fixed to the outer tube 2 by means of adhesive or, even more preferably, by means of a bi-adhesive tape 6*a*.

Also provided according to the technology disclosed herein are a pair of rod-shaped conductors 10, with a substantially circular cross-section, each comprising a conductive core 10a and an insulating coating 10*b*. The rod-shaped conductors, which are substantially rectilinear, are situated inside the outer channel 6, parallel to the longitudinal axis SA. The rod-shaped conductors have, moreover, a suitable mechanical rigidity for the purposes which will be illustrated below.

The telescopic tube according to the technology disclosed herein also comprises a locking collar 4 for fixing the outer tube 2 and the pair of rod-shaped conductors 10, as will be described herein below, and a contact block 12, which is also described below.

Figure 6:
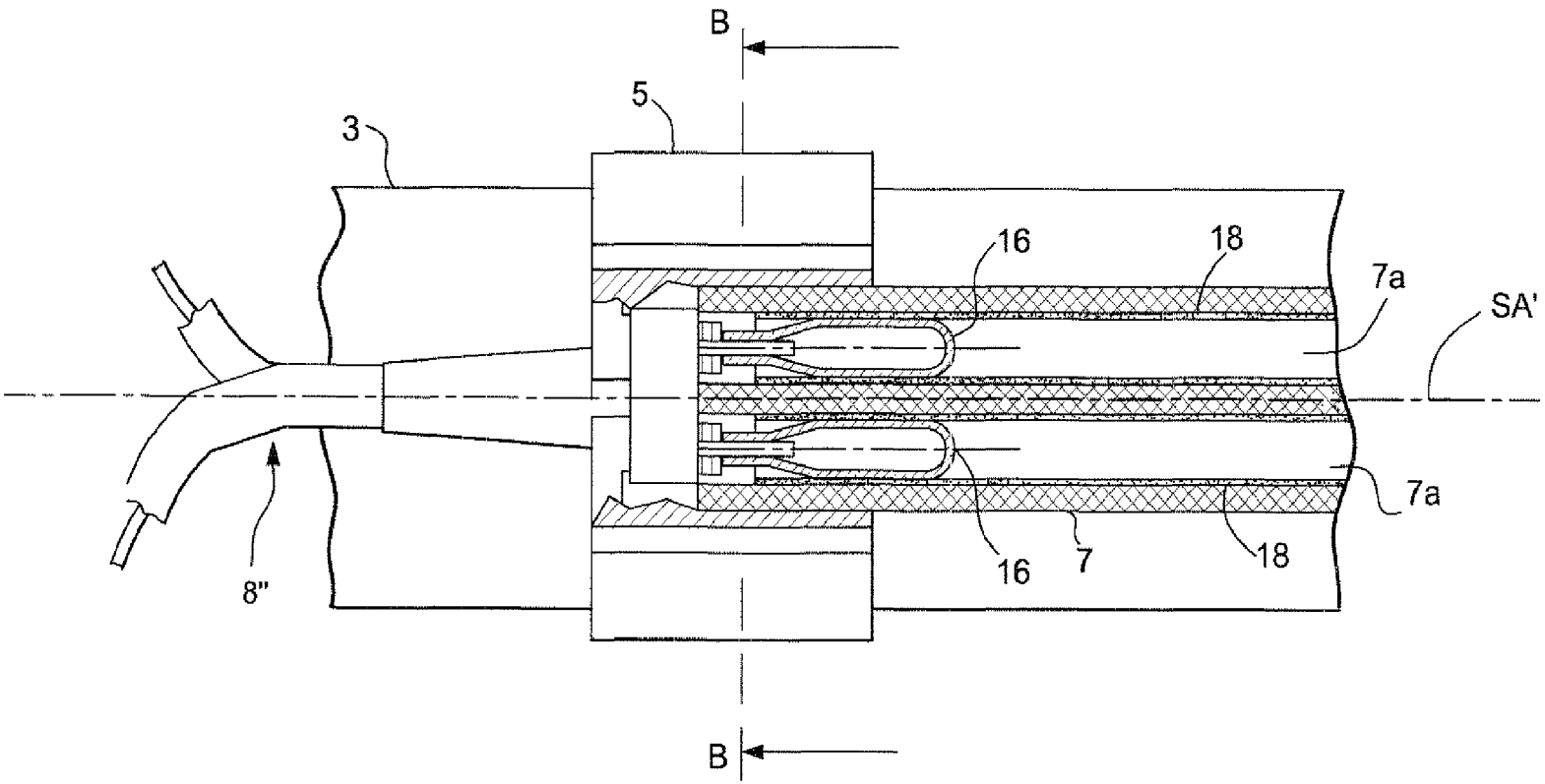
FIG. 6 is a view from above, partially longitudinally sectioned, of the left-hand end part in FIG. 3.
Figure 9:
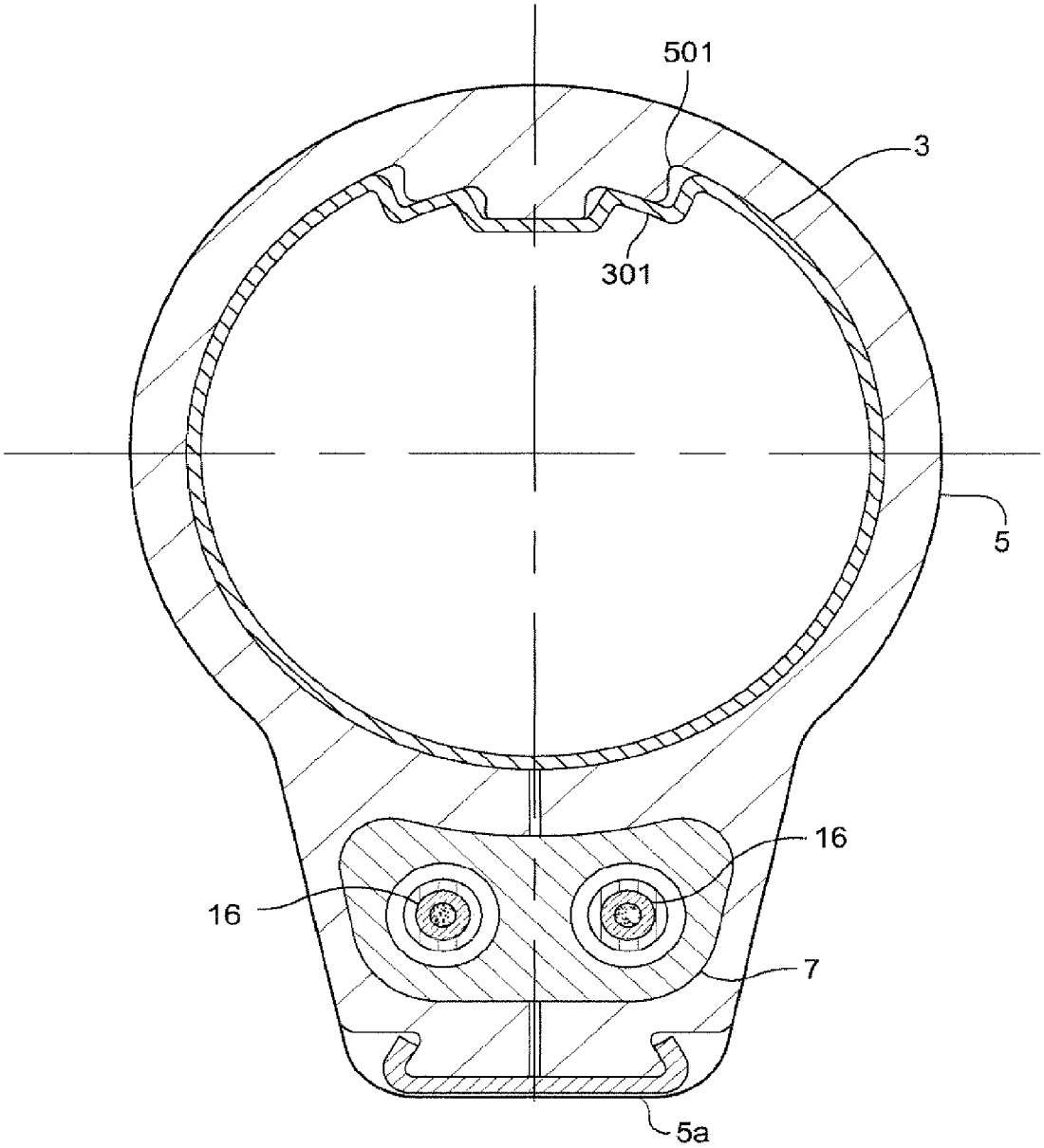
FIG. 9 is a cross-sectional view, along the line B-B of FIG. 6, of the telescopic tube according to the technology disclosed herein.

Specific reference should now be made to FIGS. 6 and 9. The inner tube 3 also has a substantially circular cross-section and has a longitudinal axis SA'. When the telescopic tube 1 is assembled, SA' preferably coincides substantially with SA. As shown in FIG. 9, a portion of the substantially circular cross-section of the inner tube 3 has an undulating shape 301, owing to the telescopic extension mechanism, which is not described further in the present description. Telescopic extension mechanisms are described in EP 0,520,534, EP 0,601,620, EP 0,987,976 or EP 1,092,383 which are incorporated herein by way of reference.

The guide body 7 has a substantially rectilinear axis and is situated parallel to the longitudinal axis SA.'. According to a preferred embodiment shown in the various figures, the guide body 7 is fixed to the inner tube 3 by means of the locking collar 5. More particularly, the guide body protrudes with respect to the collar 5 and is therefore spaced from the surface of the tube 3 substantially over the whole of its length. The shape of the cross-section of the guide body 7 is such as to allow sliding inside the outer channel 6. Preferably the shape of the cross-section of the guide body 7 substantially complements the shape of the internal cross-section of the outer channel 6. Two through-holes 7*a* parallel to the longitudinal axis SA' are formed inside the guide body 7.

The telescopic tube according to the technology disclosed herein also comprises a pair of tubular conductors 18. Each of the tubular conductors 18 engages with a respective through-hole 7*a* in the guide body 7. The tubular conductors 18 have a substantially circular cross-section. Preferably the length of the tubular conductors 18 is less than the length of the elongated body 7 which surrounds it so that the terminal sections of the through-holes 7*a* in the guide body 7 are not engaged by the tubular conductors 18.

Figure 14A:
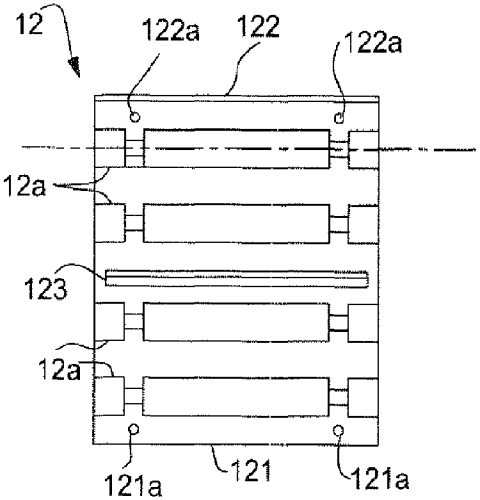
FIGS. 14*a*, 14*b* and 14*c* show views of an open contact block.
Figure 14B:
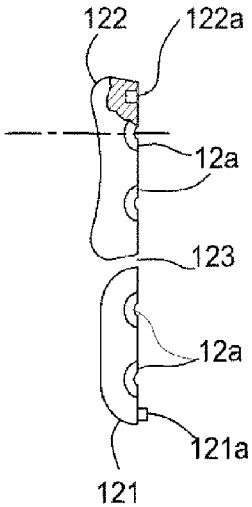

With reference again to FIG. 5 and FIGS. 14*a* and 14*b*, a contact block 12 for connecting the electric power supply cable 8' and the rod-shaped conductors 10 is described in detail. With reference to FIG. 14*a*, said contact block 12 comprises a block of insulating material which is in turn formed by two half-shells 121 and 122 connected together by means of a hinge portion 123. Two shaped grooves 12*a* which are parallel to each other and have a substantially semi-circular cross-section are formed inside each half-shell. The half-shell 121 has two pins 121*a*; the half-shell 122 has corresponding holes 122*a* which can be engaged by the pins 121*a*. Pivoting about the hinge portion 123, the half-shell 121 may be closed onto the half-shell 122 and fixed by means of insertion of the pins 121*a* into the holes 122*a* so as to match the pairs of grooves 12*a* and thus obtain a pair of circular holes.

Figure 14C:
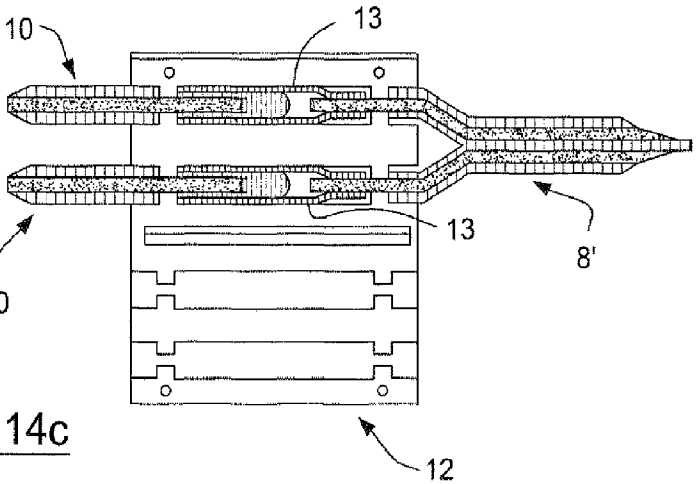

With reference now to FIG. 14*c*, the electrical connection between the power supply cable 8' and the rod-shaped conductors 10 is described. The ends of the two wires of the power supply cable 8' are stripped and fixed to the tubular conduction terminals 13. The ends of the rod-shaped conductors 10 are also stripped and placed in electrical contact with the tubular terminals 13 (for example by means of soldering). Each tubular terminal 13, once fixed to the ends of one of the rod-shaped conductors 10, is housed inside one of the half-shells 121, 122. Finally, the contact block 12, together with the rod-shaped conductors 10 and the power supply cable 8' projecting from it, is closed and locked inside the collar 4.

With reference now to FIG. 6, the electrical connection between the power supply cable 8" and the tubular conductors 18 is described. The ends of the two wires of the power supply cable 8" are stripped and fixed to conduction terminals 16. The terminals 16 may, for example, be ring-shaped. The guide body 7, comprising the pair of tubular conductors 18, is locked inside the collar 5 and the terminals 16, fixed to the ends of the wires of the cable 8", are inserted inside the tubular conductors 18 (one terminal 16 is inserted inside a respective tubular conductor).

FIGS. 12 and 13 show various views of the locking collars 4 and 5.

Figure 12A:
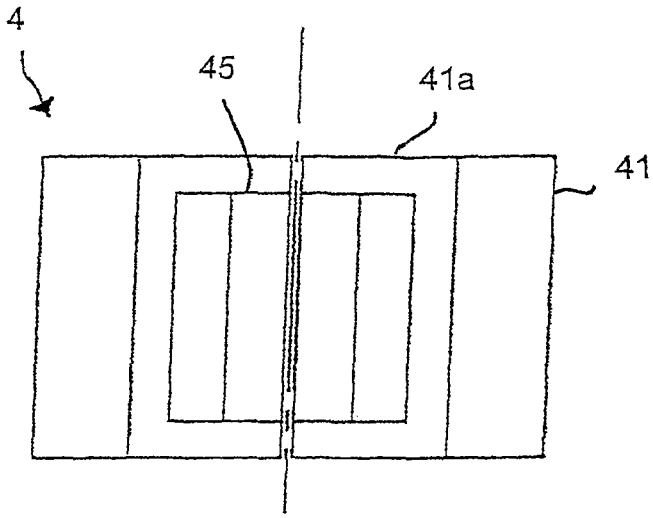
FIGS. 12*a*, 12*b* and 12*c* show the collar of the outer tube.
Figure 12B:
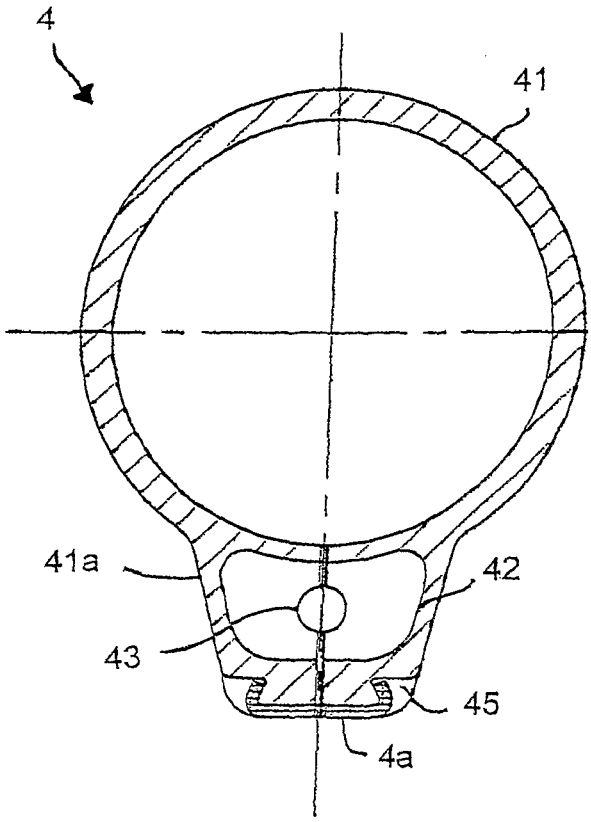
Figure 12C:
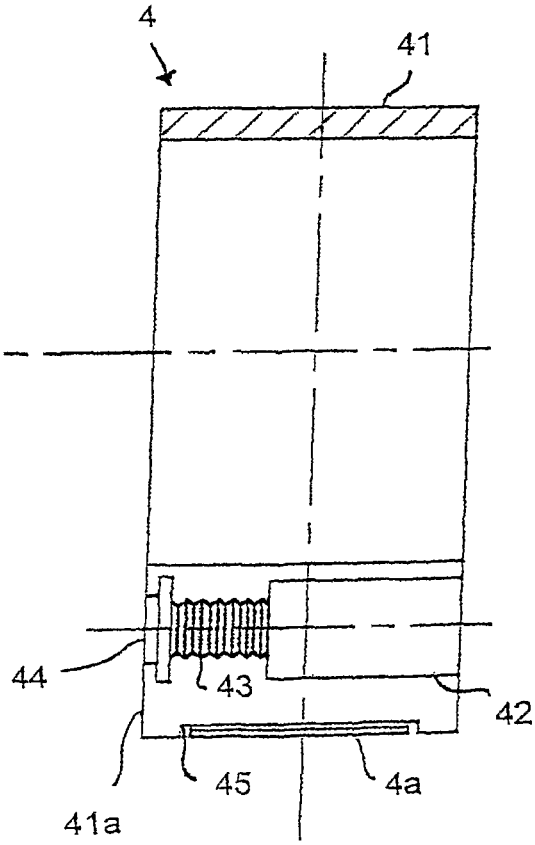

With reference to FIGS. 12*a*, 12*b* and 12*c*, the locking collar 4 is composed of a split ring 41 with a substantially circular internal cross-section, with a projecting part 41*a* which is also split longitudinally. The said projecting part 41*a* has a housing 45 for a closing clip 4*a* of the non-dismountable type. The split projecting part 41*a* defines an opening 42 for housing the contact block 12. On the opposite side there is an additional opening 44 for receiving the power supply cable 8'. The opening 42 and the additional opening 44 communicate via a duct 43.

Figure 13A:
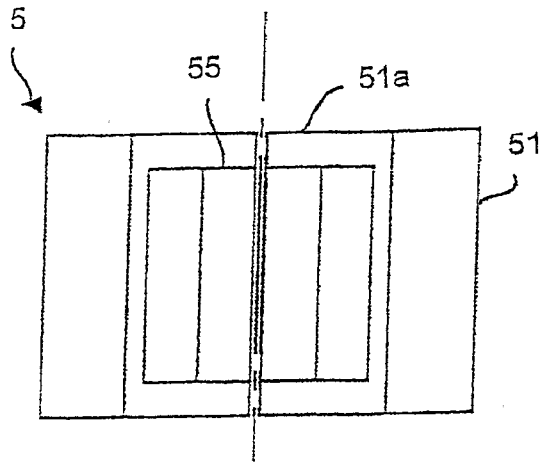
FIGS. 13*a*, 13*b* and 13*c* show the collar of the inner tube.
Figure 13B:
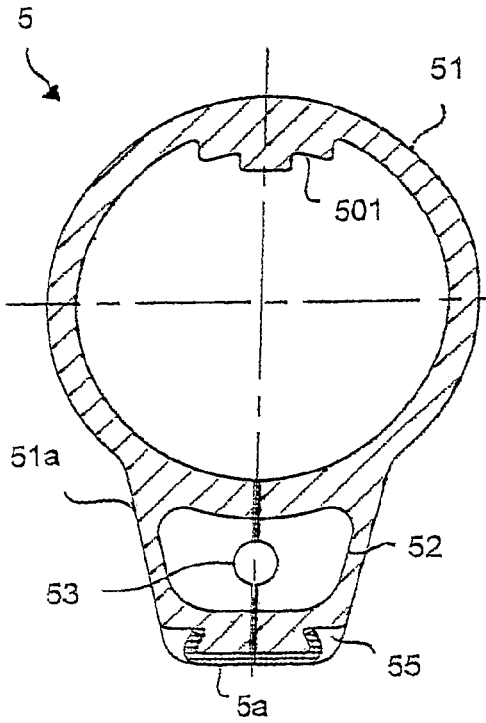
Figure 13C:
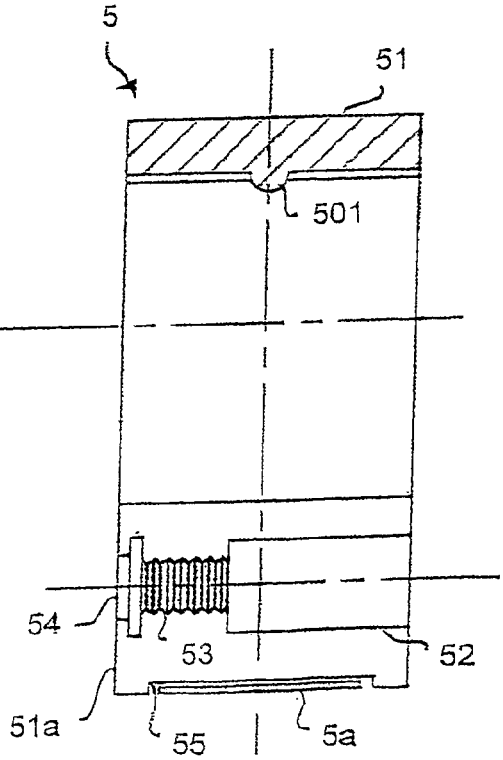

Similarly, with reference to FIGS. 13*a*, 13*b* and 13*c*, the locking collar 5 is formed by a split ring 51 with a substantially circular internal cross-section, with a projecting part 51*a* which is also split longitudinally. The said split projecting part 51*a* has a housing 55 for a closing clip 5*a* of the snap-engaging type. The split projecting part 51*a* defines an opening 52 for housing the guide body 7. On the opposite side there is an additional hole 54 for receiving the power supply cable 8". The opening 52 and the additional opening 54 communicate by means of a duct 53. As shown in FIG. 13*b*, the internal surface of a portion of the ring 51 has an undulating shape 501 substantially complementing the undulating shape 301 of the inner tube 3.

Figure 7:
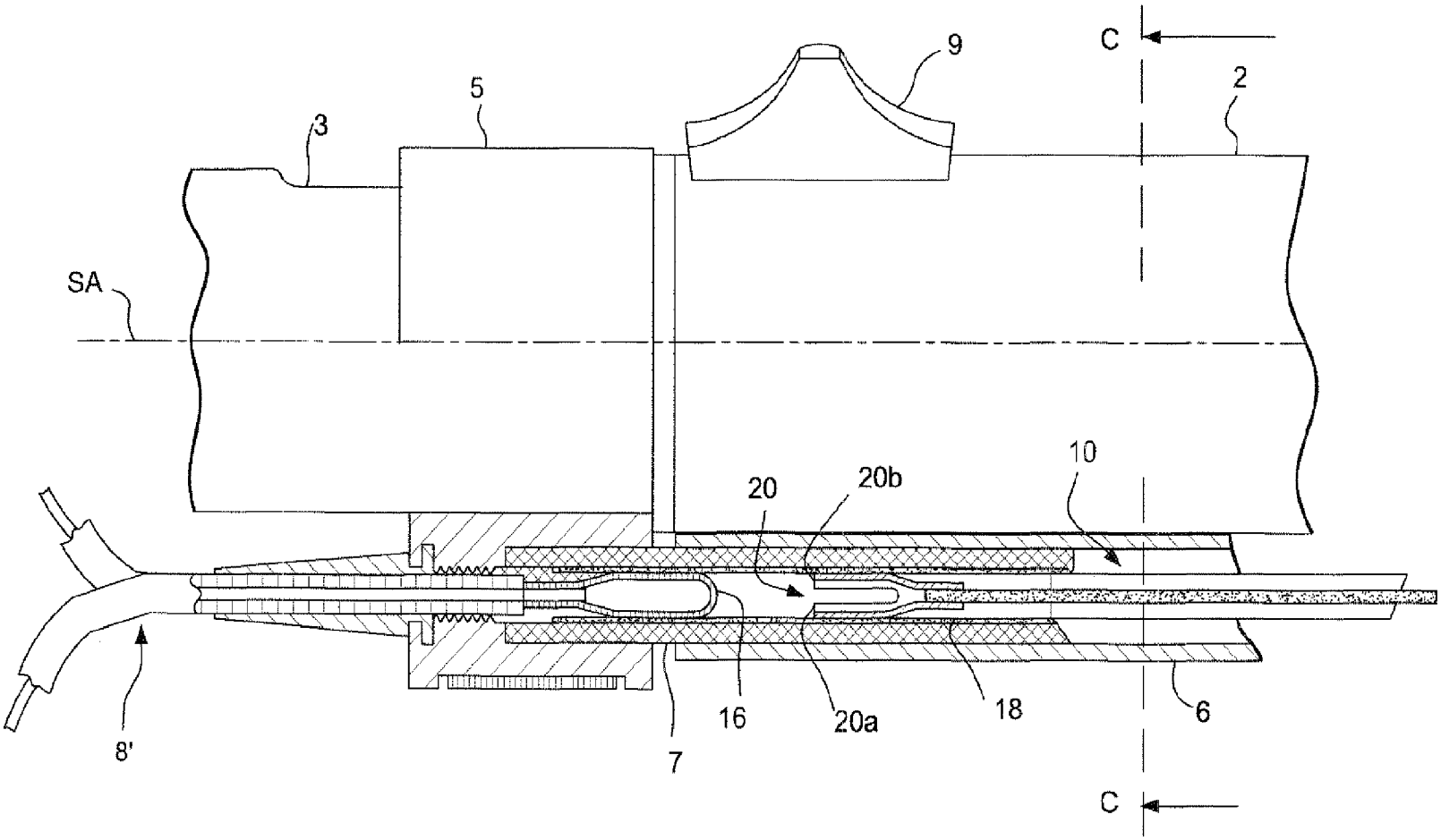
FIG. 7 is a side view, partially longitudinally sectioned, of the left-hand end part in FIG. 4.

With reference to FIG. 7, the members 20 for providing contact between the rod-shaped conductors 10 and the tubular conductors 18 are now described. Said contact members 20 are preferably in the form of a fork, the prongs 20*a* and 20*b* of which are at least partially made of conductive material and open out in the form of a "V".

Figure 10:
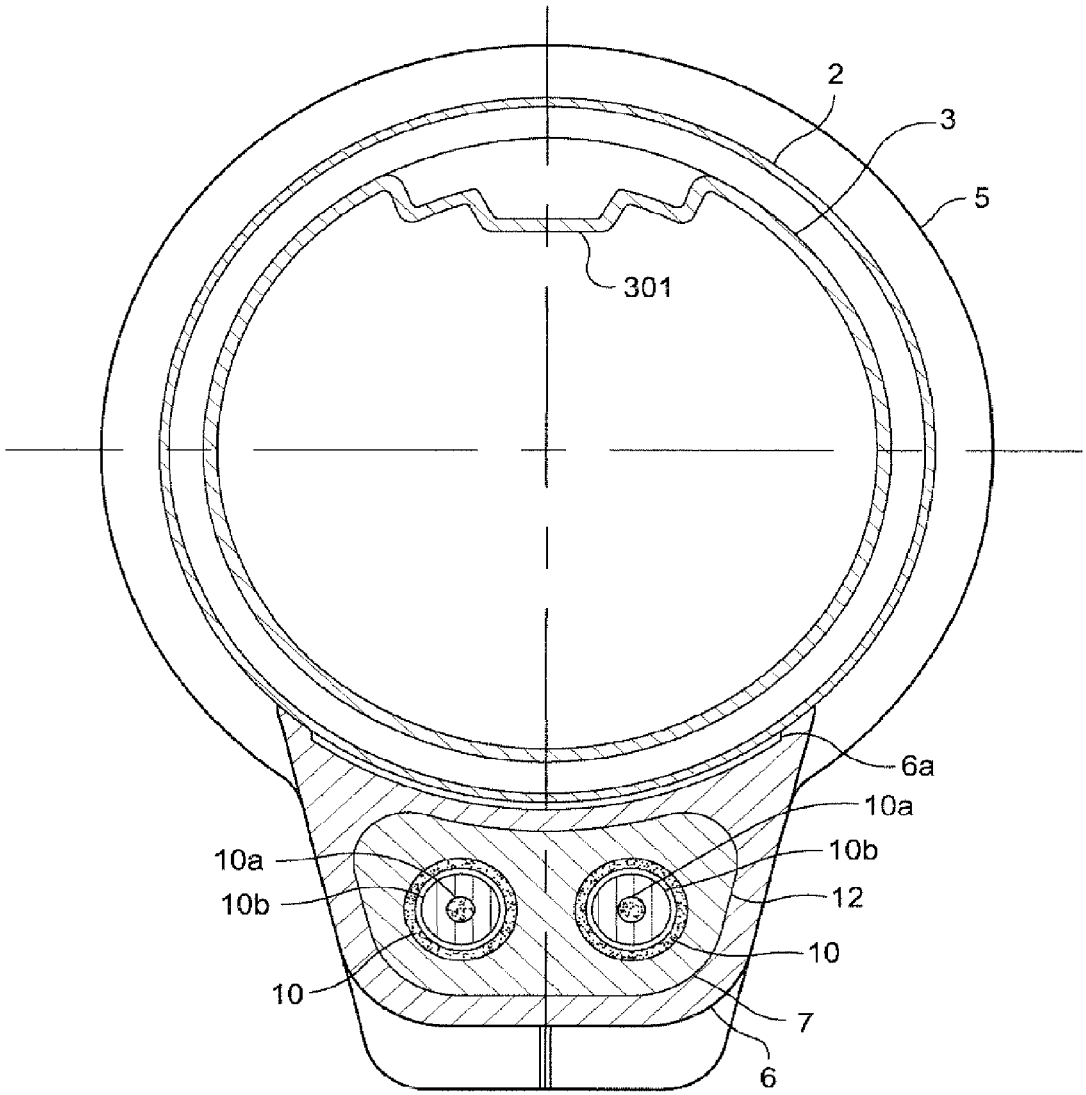
FIG. 10 is a cross-sectional view, along the line C-C of FIG. 7, of the telescopic tube according to the technology disclosed herein.
Figure 11:
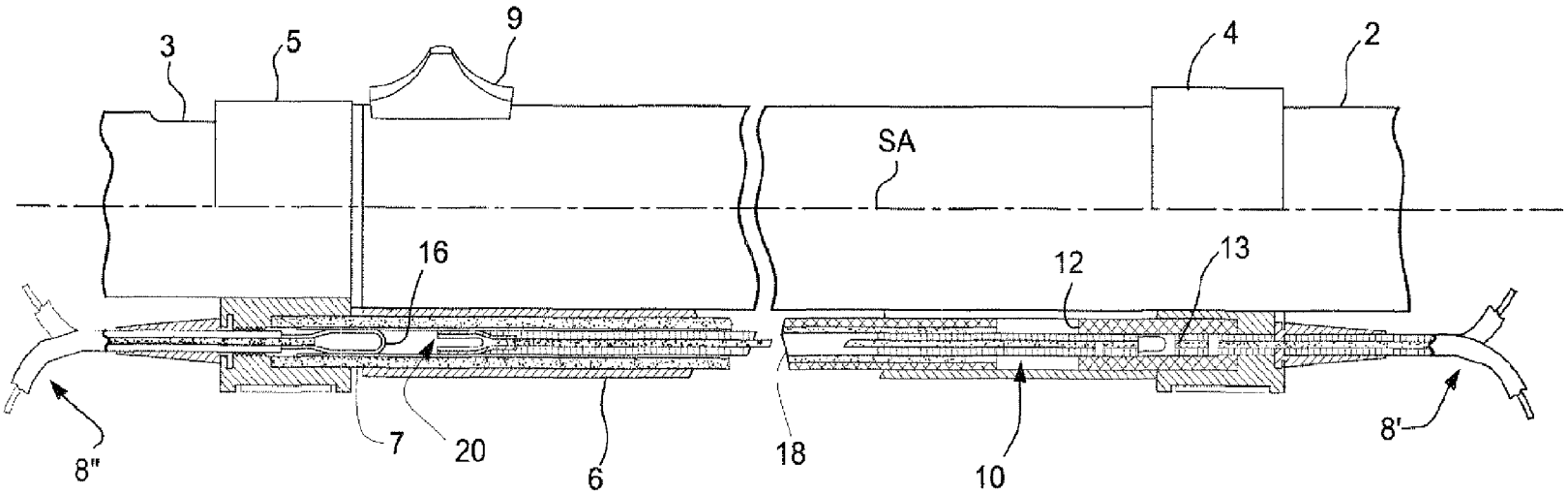
FIG. 11 is a side view, partially longitudinally sectioned, of the telescopic tube according to the technology disclosed herein.

With reference to FIGS. 7, 10 and 11, the entire telescopic tube assembled will now be described. FIG. 10 is a cross-sectional view, along the line C-C in FIG. 7, of a telescopic tube according to the technology disclosed herein. With reference in particular to this figure and to FIG. 7, it can be noted that according to the technology disclosed herein the inner tube 3 is inserted at least partially inside the outer tube 2 in a substantially concentric manner and so as to be able to slide inside it. In FIG. 10 it can also be seen that the guide body 7 engages with the outer channel 6 so as to be able to slide inside it. Moreover, the guide body 7 is inserted inside the opening 52 of the collar 5 which is in turn locked to the inner tube 3; in this way, the guide body 7 and the inner tube 3 are fixed to each other.

With reference to both FIG. 10 and FIG. 11, it can also be seen that each rod-shaped conductor 10, which is fixed at its end to a fork-shaped contact member 20, engages at least partially with a respective tubular conductor 18. The contact members 20 exert, by means of the at least partially elastic arms 20*a* and 20*b*, a pressure on the inside wall of the tubular conductors. The mechanical rigidity of the rod-shaped conductors is such as to allow said rod-shaped conductors to slide inside the tubular conductors without being deformed. In particular, the rod-shaped conductors have a rigidity such as to be able to push the contact members inside the tubular conductors without undergoing deformation. The mechanical rigidity of the rod-shaped conductors is provided by the conductive core 10*a* and/or the insulating coating 10*b*.

It is therefore clear that in a telescopic tube assembled as shown above the power supply cable 8' is in electrical contact with the rod-shaped conductors 10 by means of the tubular terminals 13, while the power supply cable 8" is in electrical contact with the tubular conductors 18 by means of the annular terminals 16. In turn, the rod-shaped conductors 10 and the tubular conductors 18 are in electrical contact by means of the contact members 20. According to the technology disclosed herein, therefore, the conduction of electricity along the telescopic tube, namely between the cable 8' and the cable 8", is ensured by the conductive path comprising the tubular terminals 13, the annular terminals 16, the rod-shaped conductors 10, the tubular conductors 18 and the pair of fork-shaped contact members 20.

According to the technology disclosed herein, this conduction path ensures the conduction of electricity along the telescopic tube, irrespective of the configuration assumed by the tube, be it closed, extended or completely extended. When the telescopic tube 1 is for example converted from its closed configuration into a general extended configuration, the inner tube 3 slides with respect to the outer tube 2 and partially protrudes from it. In a parallel manner, the guide tube 7 slides with movement integral with the tube 3 relative to the outer channel 6; this involves sliding of the rod-shaped conductors 10 with respect to the tubular conductors 18. The rod-shaped conductors 10, as they slide, convey with them the fork-shaped contact members 20 situated at their free end. These contact members 20, pressing against the walls of the tubular conductors inside which they slide together with the rod-shaped conductors, provide a sliding electrical contact with the inside walls of the tubular conductors 18, thus allowing the conduction of electricity irrespective of the relative position of the rod-shaped and tubular conductors.

The technology disclosed herein offers numerous advantages compared to the known solutions. Firstly, it is advantageous in terms of overall dimensions compared to the known tubes. The rod-shaped and tubular conductors which perform the conduction of electricity along the telescopic tube are in fact rectilinear and therefore the elements which guide the sliding movement thereof and which isolate them (i.e. the outer channel 6 and the elongated body 7) may have a dimensional cross-section which is smaller than that of ducts which must contain helically wound cables or pulley systems.

A further advantage of the technology disclosed herein comprises improved wear-resistance of the conductive and insulating parts. The conduction of electricity, according to the technology disclosed herein, is in fact performed by means of a substantially rectilinear conductors which therefore are not subject to any mechanical tension due to any bends. This prevents any breakage of the insulating coating of the conductors, which may cause short-circuits and therefore dangerous situations, in addition to damage to the electric household appliance on which the tube is mounted.

Moreover, the tube according to the technology disclosed herein is particularly advantageous in terms of the safety of insulation of the conductive parts. In one example embodiment it is in fact possible to manufacture the entire guide body containing the tubular conductors using insulating material. As a further measure, it is possible to provide tubular conductors with a length smaller than the insulating guide body and insert them into the through-holes in the guide body so that they occupy the central section of said holes, leaving the ends free. In this way, the insulation of the tubular conductors is such as to prevent accidental contact with the user.

By way of further protection, it is also possible to manufacture the outer channel using insulating material. In this way, the conductors are protected by several layers of insulating material; a further improvement in the safety of the tube is thus obtained.

A further advantage of the technology disclosed herein comprises easy manufacture and assembly of the various components. Tubes which are shaped in a particular manner are in fact not required: the tubes have a substantially circular cross-section, as do also the tubular conductors, while the rod-shaped conductors are ordinary wires with a circular cross-section. In terms of cost and simplicity of manufacture, the technology disclosed herein is therefore advantageous compared to the known solutions. From the point of view of assembly, moreover, the tube according to the technology disclosed herein is particularly simple and inexpensive since it may be assembled performing a small number of simple operations. For example, the outer duct is fixed to the outer tube by means of bi-adhesive tape; in this way the more complex and costly operation of fixing by means of screws is avoided.

It will be obvious to a person skilled in the art that the present invention may be subject to numerous modifications, adaptations, variations and replacement of parts with other functionally equivalent parts. However, all such modifications, adaptations, variations and replacement of parts must be regarded as falling within the scope of the present invention which is limited only by the following claims.

The invention claimed is:

1. A telescopic tube for an electric household appliance, comprising:

a first outer tube;

a second inner tube slidable inside said first outer tube from a first closed configuration to a second extended configuration; and electricity conduction means comprising:

a) an elongate guide body comprised of a non electrically conductive material having a first end and a second end;

b) a locking member configured to connect the first end of said elongated guide body to said second inner tube so that said elongated guide body is connected to said second inner tube in a substantially cantilever manner;

c) an outer channel connected to an outer surface of said first outer tube, said outer channel being provided for slidingly receiving said elongated guide body;

d) a pair of hollow tubular electric conductors contained in said elongated guide body; and e) a corresponding pair of substantially rigid rod electric conductors which are able to slide, at least partially, within said tubular electric conductors so that each rod electric conductor is in contact with the inner surface of a corresponding tubular electric conductor;

wherein said rod electric conductors comprise contact members engaging said tubular electric conductors so that each rod electric conductor is in sliding telescopic electric contact with the inner surface of the corresponding tubular electric conductor; and, wherein said tubular electric conductors are in the form of electrically conductive tubes embedded in said elongated guide body.

2. The telescopic tube according to claim 1, wherein said contact members are terminal members which are at least partly elastic.

3. The telescopic tube according to claim 1, wherein said rod electric conductors comprise an electric conductive core and an insulating coating.

4. The telescopic tube according to claim 1, wherein said tubular electric conductors have a first length and said elongate guide body has a second length, said first length being less than said second length.

5. The telescopic tube according to claim 1, wherein said elongate guide body is solid.

6. The telescopic tube according to claim 1, wherein said elongate guide body comprises a plastic material.

7. The telescopic tube according to claim 1, wherein said outer channel is at least partially connected to the outer surface of said first outer tube by an adhesive.

8. The telescopic tube according to claim 7, wherein said outer channel is at least partially connected to the outer surface of said first outer tube by a bi-adhesive tape.

9. The telescopic tube according to claim 1, wherein the shape of the cross-section of said elongate guide body substantially complements a shape of the internal cross-section of said outer channel.

10. The telescopic tube according to claim 1, wherein said locking member comprises terminals, said terminals being connected to wire ends of a cable and being inserted inside said tubular electric conductors.

11. The telescopic tube according to claim 1, further comprising a further locking member, said further locking member housing a contact block for connecting an electric power supply cable with said rod electric conductors.

12. An electric household appliance, comprising a telescopic tube according to claim 1.

* * * * *